US006526636B2

(12) United States Patent
Bernhardt

(10) Patent No.: US 6,526,636 B2
(45) Date of Patent: Mar. 4, 2003

(54) VESSEL FOR CREMATED REMAINS

(76) Inventor: Peter Bernhardt, 41 Maple Street, Uxbridge, ON (CA), L9P 1C8

( * ) Notice: Subject to any disclaimer, the term of this patent is extended or adjusted under 35 U.S.C. 154(b) by 0 days.

(21) Appl. No.: 09/862,478

(22) Filed: May 23, 2001

(65) Prior Publication Data

US 2001/0047575 A1 Dec. 6, 2001

(30) Foreign Application Priority Data

May 23, 2000 (CA) ..... 2,309,010

(51) Int. Cl.[7] ..... A61G 17/00
(52) U.S. Cl. ..... 27/1; 40/722; 40/725
(58) Field of Search ..... 27/1; 40/725, 792, 40/732, 722; D99/5

(56) References Cited

U.S. PATENT DOCUMENTS

| | | | | | |
|---|---|---|---|---|---|
| 398,953 | A | * | 3/1889 | East | 40/732 |
| 1,692,999 | A | * | 11/1928 | Siegel | 40/732 |
| D85,087 | S | * | 9/1931 | Clark | D99/5 |
| 3,803,738 | A | * | 4/1974 | Weiss | 220/210 |
| 5,533,241 | A | * | 7/1996 | McConnell | 27/27 |
| D374,962 | S | * | 10/1996 | Allen et al. | D99/5 |
| D398,733 | S | * | 9/1998 | Diviak, Sr. | D99/5 |
| 5,813,099 | A | * | 9/1998 | Stewart | 27/2 |
| 5,896,632 | A | * | 4/1999 | Sturino | 27/1 |
| D443,400 | S | * | 6/2001 | Robinson | D99/5 |
| D444,288 | S | * | 6/2001 | Robinson | D99/5 |
| D445,557 | S | * | 7/2001 | Chang | D99/5 |

FOREIGN PATENT DOCUMENTS

JP 08112321 A * 5/1996

* cited by examiner

*Primary Examiner*—William L Miller
(74) *Attorney, Agent, or Firm*—Birch, Stewart, Kolasch & Birch, LLP

(57) ABSTRACT

The vessel is generally cube-shaped and has a enclosed hollow interior for cremated remains. The interior is accessible only by the opening and closing of the lower panel of the vessel; otherwise the vessel is inaccessible from the outside. The vessel has decoration for visually distinguishing when the vessel is upright from when it is upside down. The front panel of the vessel has a cavity for receipt of a photograph of the deceased or an inscription.

5 Claims, 2 Drawing Sheets

VESSEL FOR CREMATED REMAINS

BACKGROUND OF THE INVENTION

This invention relates to a vessel for cremated remains of one or more deceased persons and more particularly to a vessel having a panel in which a frame is removably mounted for enclosing an inscription or a photograph of the deceased.

DESCRIPTION OF THE INVENTION

The vessel of the invention has a enclosed hollow interior for cremated remains and is defined, at the front and back, by front and rear panels respectively, at the sides by side panels and at the top and bottom by top and bottom panels respectively. The interior of the vessel is accessible only by the opening and closing of the lower panel; otherwise the vessel is inaccessible from the outside. The vessel has decoration for visually distinguishing when the vessel is upright from when it is upside down. The front panel of the vessel has a cavity formed therein for receipt of a photograph of the deceased or an inscription.

DESCRIPTION OF THE DRAWINGS

The vessel of the invention is illustrated in the accompanying drawings in which:

Like reference characters refer to like parts throughout the description of the drawings.

With reference to FIG. 1, the vessel of the invention, generally 10, has a hollow interior, not illustrated, for cremated remains. The vessel is generally rectangular in section and comprises, a front panel 12, oppositely facing side panels (one visible and marked 14), and a rear panel (not visible). The vessel has a top panel 16 and a bottom panel which is not visible.

The top panel preferably has a decorative stepped outer edge 18 formed by conventional means such as a shaper. The decorative edge serves not only as decoration but also to distinguish when the vessel is upright from when it is upside down. The top panel is permanently attached to the side panels while the bottom panel is removable to that access may be gained to the interior of the vessel.

Figure 1:
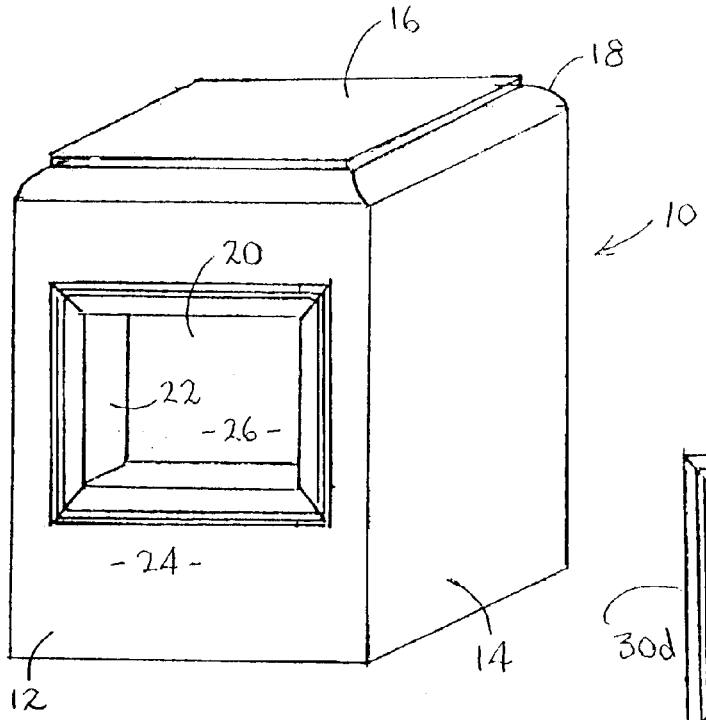
FIG. 1 is a perspective view of a first embodiment of the vessel.
Figure 5:
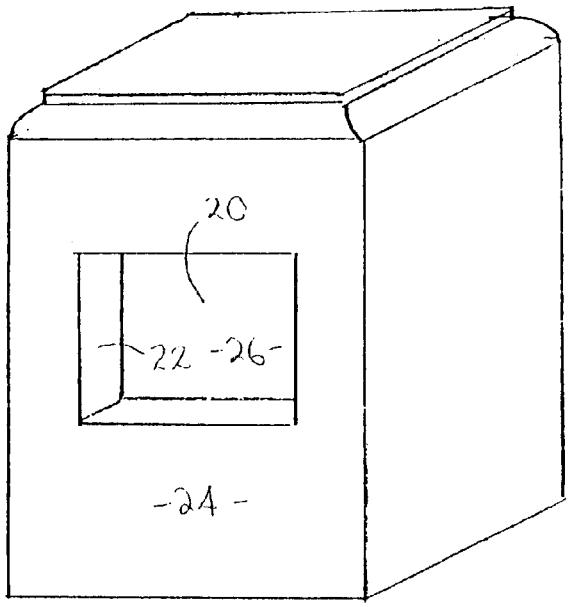
FIG. 5 is a perspective view of the vessel from which the frame has been removed.

With reference to FIGS. 1 and 5, a rectangular cavity 20 is formed in the front panel. The cavity is defined by a side edge 22 which extends inwardly from the outer wall 24 of the panel. The cavity has a flat rear wall 26 against which a photograph or an inscription is placed. The cavity may be formed by conventional means such as a router.

Figure 2:
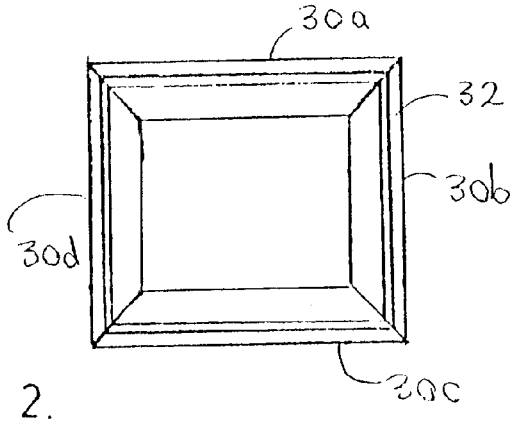
FIG. 2 is an elevation of the outer wall of a frame.

With reference to FIG. 2, the frame is rectangular and is composed of four interconnected segments 30*a, b, c*, and *d*. A decorative stepped outer edge 32 is formed on the outer edge of the segments.

Figure 3:
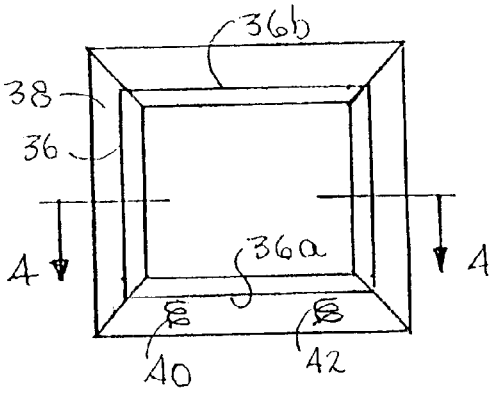
FIG. 3 is an elevation of the inner wall of the frame showing the sides opposite those shown in FIG. 2.
Figure 4:
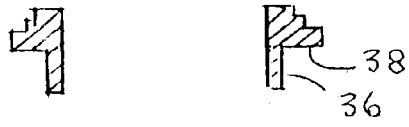
FIG. 4 is a section on line 4—4 of FIG. 3.

With reference to FIGS. 3 and 4, the inner wall of each segment which makes up the frame comprises an inwardly extending surface 36 and a lateral surface 38.

The frame is removably inserted in the cavity and is arranged and constructed such that when it is in the cavity, surfaces 36 are adjacent to the side edges 22 of the cavity throughout the extent of the surfaces. At the same time, the lateral surfaces 38 of the segments are adjacent to outer wall 24 of the vessel throughout the extent of the lateral surfaces.

The frame is constructed such that when it is in the cavity, there is a small space which separates the side edges of the cavity from the inwardly extending surfaces 36 of the frame. There is accordingly a small freedom of movement or play between the frame and the side edges of the cavity so that the frame may be freely inserted and removed from the cavity without excessive binding.

A pair of coil springs 40, 42 is attached to the inwardly extending surface 36*a* of the lowermost segment. The springs contact the side edge of the cavity when the frame is in the cavity and bias the surface 36*b* of the uppermost segment of the frame into contact with the adjacent side edge of the cavity.

The springs ensure that when the frame is in the cavity the frame does not fall out. To remove the frame, it is merely necessary to apply downward pressure to the lowermost segment of the frame to overcome the bias of the springs, then tilt the upper segment of the frame outward. The frame may then be easily withdrawn from the cavity.

Figure 6:
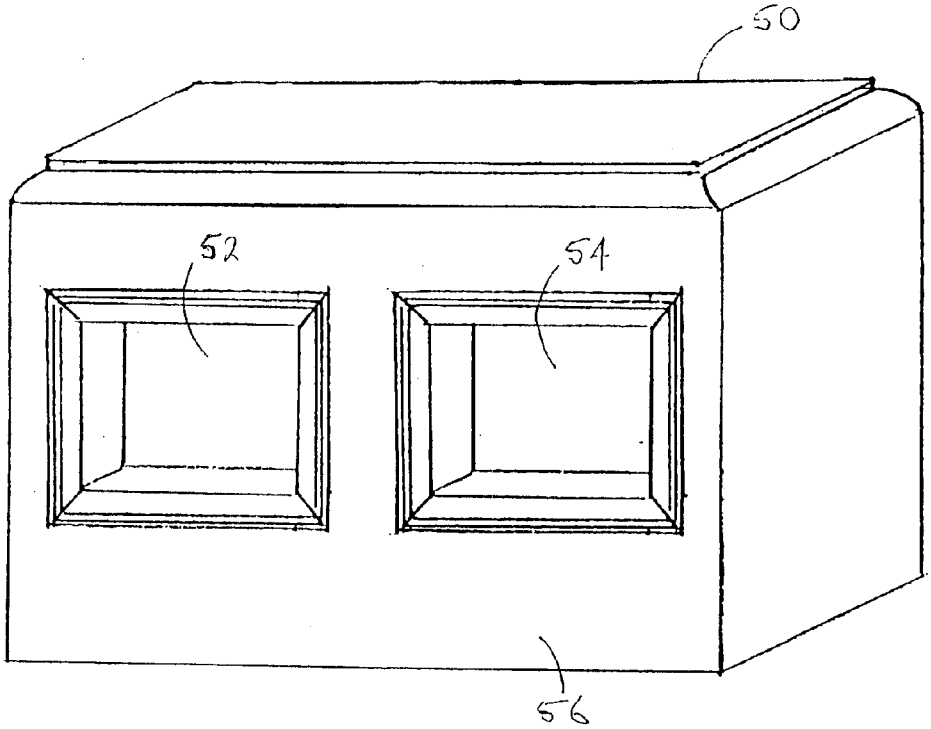
FIG. 6 is a perspective view of a second embodiment of the vessel.

With reference to FIG. 6, the vessel 50 is the same as the vessel described above except that two cavities 52, 54 are formed in its front panel 56. Such a vessel may be used to accommodate the cremated remains of two persons.

It will be understood of course that modifications can be made in the preferred embodiments illustrated and described herein without departing from the scope and purview of the invention. For example, foam plastic may be substituted for the coil springs 40, 49 to resiliently bias the inner walls of the frame against the side edge of the cavity. The shape of the vessel may be varied as may the shape of the cavities and frames. The frame may be in one piece and composed of moulded plastic.

I claim:

1. A vessel for cremated remains, said vessel having an enclosed hollow interior for said remains and being defined, at its front and back, by front and rear panels respectively, at its sides by side panels and at its top and bottom by top and bottom panels, respectively, said interior being accessible only by the opening and closing of said bottom panel and otherwise being inaccessible from outside said vessel, said vessel having decoration for visually distinguishing when said vessel is upright from when said vessel is upside down, said front panel having an outer face and at least one cavity formed therein by flat edges which extend inwardly toward said interior from said outer face, said vessel further having at least one frame comprised of interconnected segments which combine to form a single continuous border, each said segment having an inwardly extending flat surface and a lateral surface, said frame being removably accommodated in said cavity and being arranged and constructed such that when the frame is within said cavity, said inwardly extending surfaces of said segments are adjacent to said inwardly extending edges of said cavity, and resilient means which is substantially entirely contained in a space between the inwardly extending surface of one of said segments and the adjacent edge of said cavity and which biases another of said segments opposite said one segment into contact with the adjacent inwardly extending edge of said cavity said frame in order to removably maintain said frame securely within said cavity, said frame being removable by applying a force to said one segment in a direction opposed to the bias of said resilient means and by tilting said another segment outward to withdraw said frame from said cavity.

2. The vessel as claimed in claim 1 wherein said inwardly extending surfaces of said segments, throughout their entire extent, are adjacent to said inwardly extending edges of said cavity and said lateral surfaces of said segments, throughout their entire extent, are adjacent to said outer face of said front panel.

3. The vessel as claimed in claim 1 wherein said front panel has a pair of said cavities disposed side by side, each said cavity being adapted to receive a photograph or an inscription therein.

4. The vessel as claimed in claim 3 further having a pair of said frames; each said frame being removably accommodated in a separate said cavity and being arranged and constructed such that when each said frame is within each said cavity, said inwardly extending surfaces of said segments of each said segment frame are adjacent to said inwardly extending edges of the respective said cavity in which said frame is accommodated.

5. The vessel as claimed in claim 4 wherein said inwardly extending surfaces of said segments of each said frame, throughout their entire extent, are adjacent to said inwardly extending edges of the respective said cavity in which said frame is accommodated and said lateral surfaces of said segments of each said frame, throughout their entire extent, are adjacent to said outer face of said front panel.

* * * * *